US009759446B2

(12) United States Patent
Stewart et al.

(10) Patent No.: US 9,759,446 B2
(45) Date of Patent: Sep. 12, 2017

(54) AIR HANDLING UNIT WITH INTEGRAL INNER WALL FEATURES

(75) Inventors: Jeffrey L. Stewart, Whitehouse, TX (US); Mark Hudgins, Whitehouse, TX (US); Richard Lee Jameson, Tyler, TX (US); Keith Adam Novak, Holmen, WI (US); Leslie Zinger, Frankston, TX (US)

(73) Assignee: Trane International Inc., Piscataway, NJ (US)

( * ) Notice: Subject to any disclaimer, the term of this patent is extended or adjusted under 35 U.S.C. 154(b) by 608 days.

(21) Appl. No.: 12/732,772

(22) Filed: Mar. 26, 2010

(65) Prior Publication Data

US 2011/0232861 A1 Sep. 29, 2011

(51) Int. Cl.

| | |
|---|---|
| ***H05K 7/20*** | (2006.01) |
| ***F24F 13/20*** | (2006.01) |
| ***F24F 13/22*** | (2006.01) |
| ***F24F 13/28*** | (2006.01) |
| ***F24F 13/30*** | (2006.01) |

(52) U.S. Cl.
CPC ..... *F24F 13/20* (2013.01); *F24F 13/22* (2013.01); *F24F 13/28* (2013.01); *F24F 13/30* (2013.01)

(58) Field of Classification Search
CPC ..... H05K 5/00; H05K 7/20
USPC ..... 454/184, 237, 238, 248
See application file for complete search history.

(56) References Cited

U.S. PATENT DOCUMENTS

| | | | | |
|---|---|---|---|---|
| 1,796,828 A | | 3/1931 | Clingman | |
| 2,789,024 A | | 4/1957 | Heisler | |
| 3,212,285 A | | 10/1965 | Wilson | |
| 3,623,335 A | | 11/1971 | Shanner | |
| 4,415,019 A | * | 11/1983 | Hunzicker | F24F 12/001 165/122 |
| 4,723,419 A | | 2/1988 | Kessler et al. | |
| 4,825,847 A | | 5/1989 | Perron | |
| 4,972,298 A | | 11/1990 | Casa et al. | |
| 5,160,481 A | * | 11/1992 | Weaver | C01B 13/11 422/186.07 |
| 5,170,550 A | | 12/1992 | Cox et al. | |
| 5,255,969 A | | 10/1993 | Cox et al. | |
| 5,277,036 A | | 1/1994 | Dieckmann et al. | |
| 5,396,782 A | * | 3/1995 | Ley | F16F 15/04 248/636 |
| 5,450,285 A | | 9/1995 | Schlemmer | |
| 5,485,954 A | | 1/1996 | Guy et al. | |
| 5,517,387 A | | 5/1996 | Smith | |

(Continued)

FOREIGN PATENT DOCUMENTS

| | | |
|---|---|---|
| CN | 2226126 A | 5/1996 |
| CN | 2226126 Y | 5/1996 |

(Continued)

OTHER PUBLICATIONS

Lackie, Scott A., et al.; U.S. Appl. No. 12/732,762, filed Mar. 26, 2010; "Air Handling Unit With Inner Wall Space;".

(Continued)

*Primary Examiner* — Steven B McAllister
*Assistant Examiner* — Samantha Miller
(74) *Attorney, Agent, or Firm* — Conley Rose, P.C.; J. Robert Brown, Jr.

(57) ABSTRACT

An air handling unit has an interior wall configured to selectively retain a removable component of the air handling unit. An air handling unit has an interior wall configured as a drain pan. An air handling unit has an outer skin joined to the interior wall, an insulator disposed between the interior wall and the outer skin, and the interior wall has a mounting channel configured to selectively retain a removable component of the air handling unit.

11 Claims, 6 Drawing Sheets

(56) References Cited

U.S. PATENT DOCUMENTS

| | | | | |
|---|---|---|---|---|
| 5,582,026 | A * | 12/1996 | Barto, Sr. | F24F 1/0003 62/298 |
| 5,622,058 | A | 4/1997 | Ramakrishnan et al. | |
| 5,825,847 | A | 10/1998 | Ruth et al. | |
| 5,897,181 | A | 4/1999 | Avendano et al. | |
| 5,992,960 | A | 11/1999 | Wolanin | |
| 6,088,225 | A | 7/2000 | Parry et al. | |
| 6,658,904 | B2 | 12/2003 | Herbeck et al. | |
| 6,676,234 | B2 | 1/2004 | Herbeck et al. | |
| 6,781,831 | B1 | 8/2004 | Banton et al. | |
| 6,788,544 | B1 | 9/2004 | Barsun et al. | |
| 6,807,056 | B2 | 10/2004 | Kondo et al. | |
| 6,879,486 | B1 | 4/2005 | Banton et al. | |
| 6,974,383 | B2 | 12/2005 | Lewis et al. | |
| 6,987,673 | B1 | 1/2006 | French et al. | |
| 7,108,478 | B2 * | 9/2006 | Hancock | F04D 17/02 415/108 |
| 7,187,547 | B1 | 3/2007 | French et al. | |
| 7,286,356 | B2 | 10/2007 | Keenan et al. | |
| 7,489,509 | B2 | 2/2009 | Keenan et al. | |
| 7,598,461 | B2 | 10/2009 | Kitamura et al. | |
| 7,643,285 | B2 | 1/2010 | Nishiyama et al. | |
| 7,914,366 | B2 | 3/2011 | Miyamoto et al. | |
| 8,070,242 | B2 | 12/2011 | Makabe | |
| 8,072,752 | B2 | 12/2011 | Wantschik | |
| 8,300,410 | B2 | 10/2012 | Slessman | |
| 8,717,747 | B2 | 5/2014 | Chen et al. | |
| 2002/0101117 | A1 | 8/2002 | Shibuya | |
| 2005/0135059 | A1 | 6/2005 | Araki et al. | |
| 2005/0168929 | A1 | 8/2005 | Inoue et al. | |
| 2005/0231915 | A1 | 10/2005 | Keenan et al. | |
| 2005/0270751 | A1 | 12/2005 | Coglitore et al. | |
| 2006/0087801 | A1 | 4/2006 | Champion et al. | |
| 2007/0129000 | A1 * | 6/2007 | Rasmussen et al. | 454/184 |
| 2007/0213000 | A1 | 9/2007 | Day | |
| 2007/0257487 | A1 | 11/2007 | Jacklich et al. | |
| 2008/0086994 | A1 * | 4/2008 | Descotes | B03C 3/011 55/471 |
| 2009/0016009 | A1 | 1/2009 | Barrall et al. | |
| 2009/0071746 | A1 | 3/2009 | Teisseyre | |
| 2009/0305621 | A1 | 12/2009 | Eckardt et al. | |
| 2011/0056651 | A1 * | 3/2011 | Monk et al. | 165/80.2 |
| 2011/0232861 | A1 * | 9/2011 | Stewart | F24F 13/20 165/59 |
| 2014/0213172 | A1 * | 7/2014 | Jameson | F24F 3/044 454/284 |
| 2015/0111488 | A1 * | 4/2015 | Son | F24F 3/044 454/329 |

FOREIGN PATENT DOCUMENTS

| | | | |
|---|---|---|---|
| CN | 1690534 | A | 11/2005 |
| CN | 2811822 | Y | 8/2006 |
| CN | 1888585 | A | 1/2007 |
| CN | 1979015 | A | 6/2007 |
| CN | 101440979 | A | 5/2009 |
| CN | 201297715 | Y | 8/2009 |
| CN | 201340028 | Y | 11/2009 |
| KR | 100781267 | B1 | 11/2007 |
| KR | 100851500 | B1 | 8/2008 |
| WO | 9424493 | | 10/1994 |
| WO | 9913273 | A1 | 3/1999 |
| WO | 0150067 | A2 | 7/2001 |

OTHER PUBLICATIONS

Stewart, Jeffrey L., et al.; U.S. Appl. No. 12/732,777, filed Mar. 26, 2010; "Modular Air Handling Unit;".
Chinese Office Action; Application No. 201110081227.X; dated Mar. 25, 2013; 18 pages.
Final Office Action dated Nov. 5, 2013; U.S. Appl. No. 12/732,762, filed Mar. 26, 2010; 22 pages.
Final Office Action dated Oct. 15, 2013; U.S. Appl. No. 12/732,777, filed Mar. 26, 2010; 23 pages.
Canadian Office Action; Application No. 2,733,052; dated Nov. 15, 2013; 2 pages.
Chinese Office Action; Application No. 201110081439.8; dated Sep. 22, 2013; 11 pages.
Canadian Office Action; Application No. 2,733,051; dated Nov. 15, 2013; 2 pages.
Office Action dated Mar. 27, 2013; U.S. Appl. No. 12/732,762, filed Mar. 26, 2010; 15 pages.
Office Action dated Mar. 27, 2013; U.S. Appl. No. 12/732,777, filed Mar. 26, 2010; 16 pages.
Canadian Office Action; Application No. 2,733,052; dated Mar. 8, 2013; 2 pages.
Chinese Office Action; Application No. 201110081439.8; dated Feb. 17, 2013; 11 pages.
Canadian Office Action; Application No. 2,733,051; dated Mar. 19, 2013; 2 pages.
Chinese Office Action; Application No. 201110081439.8; dated Apr. 15, 2014; 38 pages.
Chinese Office Action; Application No. 201110081227.X; dated May 14, 2014; 30 pages.
Chinese Office Action; Application No. 201110081439.8; dated Jul. 3, 2014; 14 pages.
Chinese Office Action; Application No. 201110081227.X; dated Jan. 13, 2014; 29 pages.
Canadian Office Action; Application No. 2,733,052; dated Sep. 5, 2014; 2 pages.
Chinese Office Action; Application No. 201110081227.X; dated Oct. 8, 2014; 7 pages.
Chinese Office Action; Application No. 201110081439.8; dated Jan. 15, 2015; 10 pages.
Advisory Action dated Jan. 15, 2014; U.S. Appl. No. 12/732,762, filed Mar. 26, 2010; 3 pages.
Office Action dated Oct. 8, 2014; U.S. Appl. No. 12/732,762, filed Mar. 26, 2010; 31 pages.
Advisory Action dated Dec. 31, 2013; U.S. Appl. No. 12/732,777, filed Mar. 26, 2010; 7 pages.
Office Action dated Aug. 8, 2014; U.S. Appl. No. 12/732,777, filed Mar. 26, 2010; 25 pages.
Final Office Action dated Feb. 17, 2015; U.S. Appl. No. 12/732,777, filed Mar. 26, 2010; 19 pages.
Final Office Action dated May 11, 2015; U.S. Appl. No. 12/732,762, filed Mar. 26, 2010; 25 pages.
Advisory Action dated Apr. 24, 2015; U.S. Appl. No. 12/732,777, filed Mar. 26, 2010; 3 pages.
Advisory Action dated May 22, 2015; U.S. Appl. No. 12/732,777, filed Mar. 26, 2010; 4 pages.
Advisory Action dated Aug. 26, 2015; U.S. Appl. No. 12/732,762, filed Mar. 26, 2010; 7 pages.
Office Action dated Jul. 17, 2015; U.S. Appl. No. 12/732,777, filed Mar. 26, 2010; 19 pages.
Advisory Action dated Nov. 13, 2015; U.S. Appl. No. 12/732,762, filed Mar. 26, 2010; 5 pages.
Office Action dated Dec. 18, 2015; U.S. Appl. No. 12/732,762, filed Mar. 26, 2010; 13 pages.
Final Office Action dated Dec. 17, 2015; U.S. Appl. No. 12/732,777, filed Mar. 26, 2010; 21 pages.
Advisory Action dated Feb. 2, 2016; U.S. Appl. No. 12/732,777, filed Mar. 26, 2010; 3 pages.
Advisory Action dated Mar. 10, 2016; U.S. Appl. No. 12/732,777, filed Mar. 26, 2010; 4 pages.
Office Action dated Apr. 21, 2016; U.S. Appl. No. 12/732,777, filed Mar. 26, 2010; 20 pages.
Final Office Action dated May 20, 2016; U.S. Appl. No. 12/732,762, filed Mar. 26, 2010; 9 pages.
Advisory Action dated Jun. 16, 2016; U.S. Appl. No. 12/732,762, filed Mar. 26, 2010; 3 pages.
Final Office Action dated Jul. 5, 2016; U.S. Appl. No. 12/732,777, filed Mar. 26, 2010; 17 pages.
Advisory Action dated Aug. 26, 2016; U.S. Appl. No. 12/732,762, filed Mar. 26, 2010; 4 pages.

(56) References Cited

OTHER PUBLICATIONS

Office Action dated Oct. 21, 2016; U.S. Appl. No. 12/732,762, filed Mar. 26, 2010; 13 pages.
Advisory Action dated Aug. 26, 2016; U.S. Appl. No. 12/732,777, filed Mar. 26, 2010; 3 pages.
Final Office Action dated Feb. 10, 2017; U.S. Appl. No. 12/732,762, filed Mar. 26, 2010; 19 pages.
Indian Office Action; Application No. 277/KOL/2011; Dec. 26, 2016; 8 pages.
Indian Office Action; Application No. 278/KOL/2011; Jan. 3, 2017; 8 pages.
Chinese Office Action; Application No. 201110081227.X; dated Sep. 6, 2013; 9 pages.
Advisory Action dated Apr. 20, 2017; U.S. Appl. No. 12/732,762, filed Mar. 26, 2010; 4 pages.
Notice of Allowance dated Apr. 29, 2017; U.S. Appl. No. 12/732,777, filed Mar. 26, 2010; 23 pages.

* cited by examiner

AIR HANDLING UNIT WITH INTEGRAL INNER WALL FEATURES

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) sometimes comprise air handling units comprising double-wall construction.

SUMMARY OF THE DISCLOSURE

In some embodiments, an air handling unit is provided that comprises an interior wall configured to selectively retain a removable component of the air handling unit.

In other embodiments, an air handling unit is provided that comprises an interior wall configured as a drain pan.

In yet other embodiments, an air handling unit is provided that comprises an interior wall, an outer skin joined to the interior wall, and an insulator disposed between the interior wall and the outer skin. The interior wall comprises a mounting channel configured to selectively retain a removable component of the air handling unit.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Interior walls of some air handling units may be planar in construction, covered with insulation that may release particulate matter, and may be configured to carry a plurality of brackets for carrying removable components of the air handling units. The removable components of such air handling units may need to be rearranged to configure the air handling unit for use in a particular installation configuration with respect to the direction of gravity. For example, a removable drain pan may need to be relocated within the air handling unit for use in a particular installation configuration. Still further, construction of the air handling units may be time consuming and/or difficult due to a need to install a variety of brackets and/or support structures to the interior walls of the air handling units. Further, removal and/or replacement of the removable components of some current air handling units may be unnecessarily difficult due to complicated multi-piece mounting brackets and supports.

Accordingly, the present disclosure provides, among other features, an air handling unit (AHU) that comprises interior cabinet walls shaped and/or otherwise configured to selectively carry removable components of the AHU with a reduced need for brackets and supports. The interior cabinet walls of the AHU of the present disclosure may be further shaped and/or otherwise configured to reduce or eliminate the need to rearrange components within the AHU to configure the AHU for a selected installation orientation relative to the direction of gravity. In some embodiments, an AHU of the disclosure may comprise interior cabinet walls that are formed and/or shaped to integrally comprise brackets and/or other mounting features for carrying removable components. In some embodiments, an AHU may comprise integral drain pans, the integral drain pans being suitable for use in different installation orientations with respect to the direction of gravity.

Figure 1:
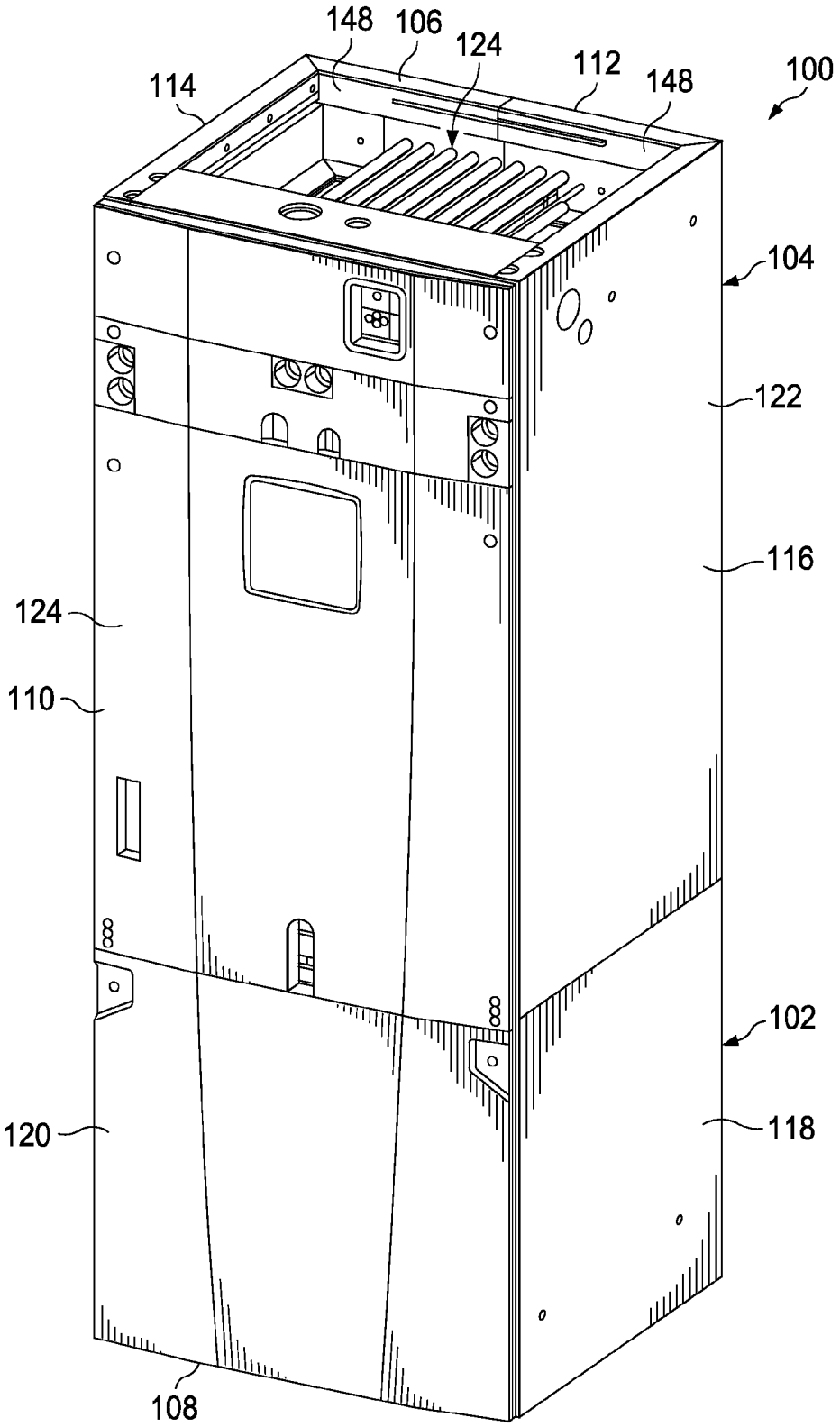
FIG. 1 is an oblique view of an air handling unit according to embodiments of the disclosure.
Figure 2:
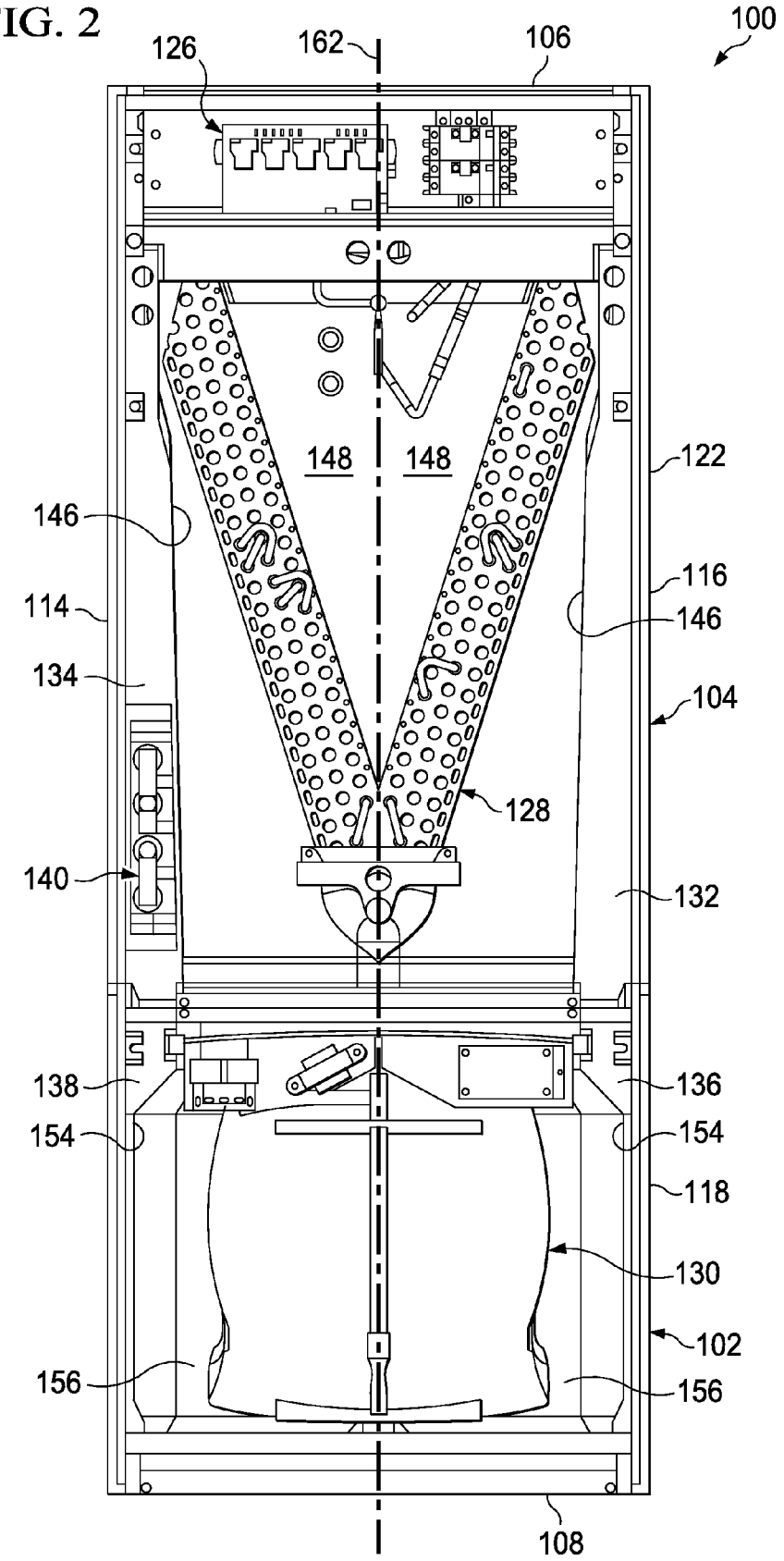
FIG. 2 is an orthogonal view of the front of the air handling unit of FIG. 1.
Figure 3:
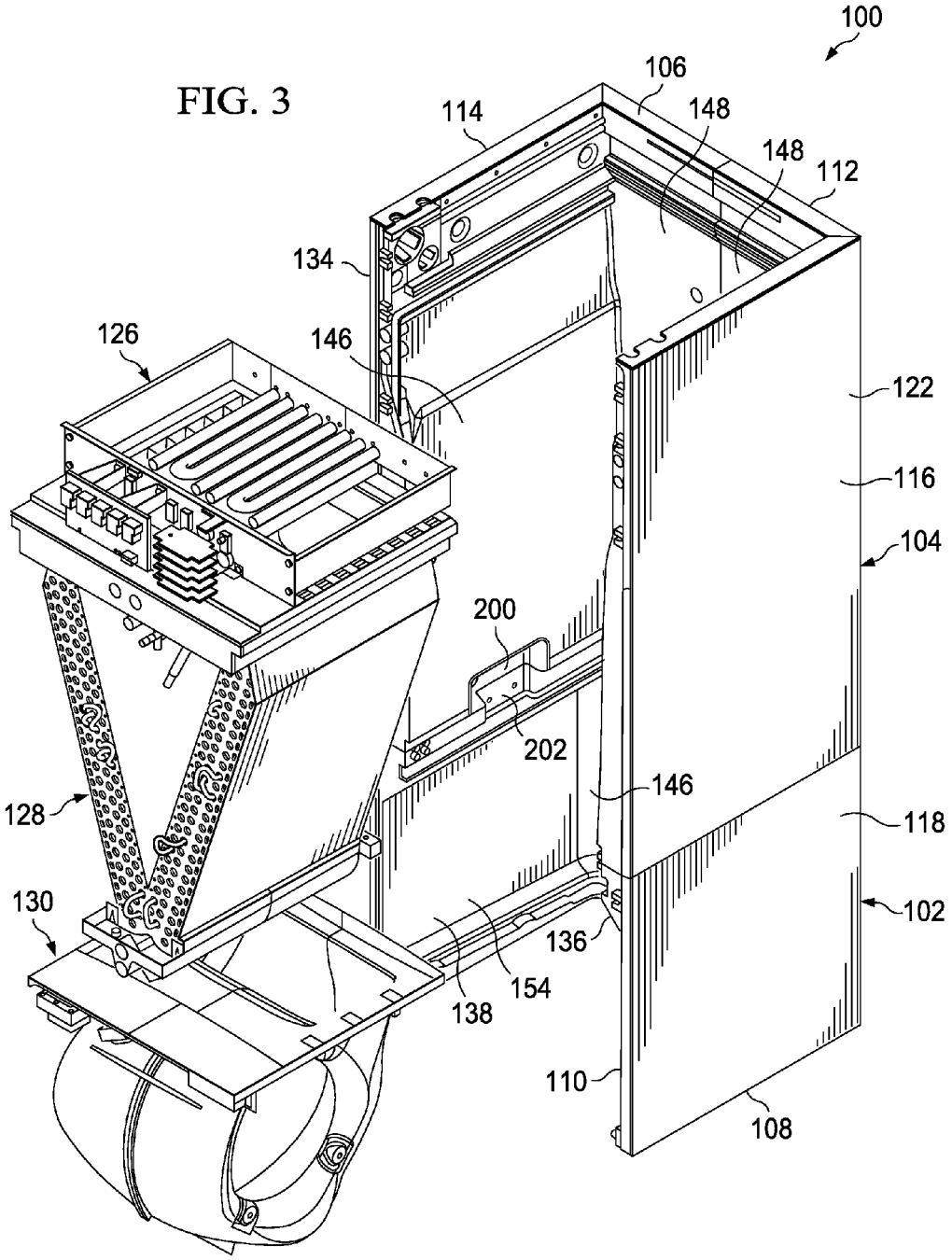
FIG. 3 is a partially exploded oblique view of the air handling unit of FIG. 1.

Referring now to FIGS. 1-3, an AHU 100 according to the disclosure is shown. In this embodiment, AHU 100 comprises a lower blower cabinet 102 attached to an upper heat exchanger cabinet 104. Most generally and for purposes of this discussion, AHU 100 may be described as comprising a top side 106, a bottom side 108, a front side 110, a back side 112, a left side 114, and a right side 116. Such directional descriptions are meant to assist the reader in understanding the physical orientation of the various components parts of the AHU 100 but that such directional descriptions shall not be interpreted as limitations to the possible installation orientations of an AHU 100. Further, the above-listed directional descriptions may be shown and/or labeled in the figures by attachment to various component parts of the AHU 100. Attachment of directional descriptions at different locations or two different components of AHU 100 shall not be interpreted as indicating absolute locations of directional limits of the AHU 100, but rather, that a plurality of shown and/or labeled directional descriptions in a single Figure shall provide general directional orientation to the reader so that directionality may be easily followed amongst various the Figures. Still further, the component parts and/or assemblies of the AHU 100 may be described below as generally having top, bottom, front, back, left, and right sides which should be understood as being consistent in orientation with the top side 106, bottom side 108, front side 110, back side 112, left side 114, and right side 116 of the AHU 100.

Blower cabinet 102 comprises a four-walled fluid duct that accepts fluid (air) in through an open bottom side of the blower cabinet 102 and allows exit of fluid through an open top side of the blower cabinet 102. In this embodiment, the exterior of the blower cabinet 102 comprises a blower cabinet outer skin 118 and a blower cabinet panel 120. The blower cabinet panel 120 is removable from the remainder of the blower cabinet 102 thereby allowing access to an interior of the blower cabinet 102. Similarly, heat exchanger cabinet 104 comprises a four-walled fluid duct that accepts fluid (air) from the blower cabinet 102 and passes the fluid from an open bottom side of the heat exchanger cabinet 104 and allows exit of the fluid through an open top side of the heat exchanger cabinet 104. In this embodiment, the exterior of the heat exchanger cabinet 104 comprises a heat exchanger cabinet outer skin 122 and a heat exchanger cabinet panel 124. The heat exchanger cabinet panel 124 is removable from the remainder of the heat exchanger cabinet 104 thereby allowing access to an interior of the heat exchanger cabinet 104.

The AHU 100 further comprises a plurality of selectively removable components. More specifically, the AHU 100 comprises a heater assembly 126 and may be removably carried within the heat exchanger cabinet 104. The AHU 100 further comprises a refrigeration coil assembly 128 that may also be removably carried within the heat exchanger cabinet 104. In this embodiment, the heater assembly 126 is configured to be optionally carried within heat exchanger cabinet 104 nearer the top side 106 of the AHU 100 than the refrigeration coil assembly 128. Similarly, the AHU 100 comprises a blower assembly 130 that may be removably carried within the blower cabinet 102. The AHU 100 may be considered fully assembled when the blower assembly 130 is carried within the blower cabinet 102, each of the refrigeration coil assembly 128 and the heater assembly 126 are carried within the heat exchanger cabinet 104, and when the blower cabinet panel 120 and heat exchanger cabinet panel 124 are suitably associated with the blower cabinet outer skin 118 and the heat exchanger cabinet outer skin 122, respectively. When the AHU 100 is fully assembled, fluid (air) may generally follow a path through the AHU 100 along which the fluid enters through the bottom side 108 of the AHU 100, successively encounters the blower assembly 130, the refrigeration coil assembly 128, and the heater assembly 126, and thereafter exits the AHU 100 through the top side 106 of the AHU 100.

In this embodiment, each of the four walls of the blower cabinet 102 and the heat exchanger cabinet 104 are configured to have a double-wall construction. More specifically, the heat exchanger cabinet 104 further comprises a heat exchanger cabinet right shell 132 and a heat exchanger cabinet left shell 134. In this embodiment, the heat exchanger cabinet right shell 132 and the heat exchanger cabinet left shell 134 may be joined to generally form the interior of the heat exchanger cabinet 104. In order to form the above-mentioned double-wall construction for the heat exchanger cabinet 104, the heat exchanger cabinet outer skin 122 generally covers the right side and back side of the heat exchanger cabinet right shell 132 while also generally covering the left side and back side of the heat exchanger cabinet left shell 134. Most generally, the heat exchanger cabinet right shell 132, the heat exchanger cabinet left shell 134, and the heat exchanger cabinet outer skin 122 are shaped so that upon their assembly together a heat exchanger cabinet wall space exists between the heat exchanger cabinet outer skin 122 and each of the heat exchanger cabinet right shell 132 and the heat exchanger cabinet left shell 134. The blower cabinet right shell 136, the blower cabinet left shell 138, and the blower cabinet outer skin 118 are also shaped so that upon their assembly together a blower cabinet wall space exists between the blower cabinet outer skin 118 and each of the blower cabinet right shell 136 and the blower cabinet left shell 138.

In some embodiments, one or more of the heat exchanger cabinet wall space and blower cabinet wall space may be at least partially filled with an insulating material. More specifically, in some embodiments, a polyurethane foam may at least partially fill exchanger cabinet wall space and the lower cabinet wall space. At least partially filling one or more of the spaces may increase a structural integrity of the AHU 100, may increase a thermal resistance of the AHU 100 between the interior of the AHU 100 and the exterior of the AHU 100, may decrease air leakage from the AHU 100, and may reduce and/or eliminate the introduction of volatile organic compounds (VOCs) into breathing air attributable to the AHU 100. Such a reduction in VOC emission by the AHU 100 may be attributable to the lack of and/or reduced use of traditional fiberglass insulation within the AHU 100 made possible by the insulative properties provided by the polyurethane foam within the spaces.

In some embodiments, each of the blower cabinet outer skin 118 and the heat exchanger cabinet outer skin 122 may be constructed of metal and/or plastic. Each of the heat exchanger cabinet right shell 132, the heat exchanger cabinet left shell 134, blower cabinet right shell 136, and blower cabinet left shell 138 may be constructed of a sheet molding compound (SMC). The SMC may be chosen for its ability to meet the primary requirements of equipment and/or safety certification organizations and/or its relatively rigid cleanable surfaces that are resistant to mold growth and compatible with the use of antimicrobial cleaners. Further, the polyurethane foam used to fill the spaces may comprise refrigerant and/or pentane to enhance the thermal insulating characteristics of the foam. Of course, in alternative embodiments, any other suitable material may be used to form the components of the AHU 100.

Further, each of the heat exchanger cabinet right shell 132 and the heat exchanger cabinet left shell 134 comprise an interior side surface 146, an interior rear surface 148, an exterior side surface, and an exterior rear surface. Similarly, each of the blower cabinet right shell 136 and the blower cabinet left shell 138 comprise an interior side surface 154, an interior rear surface 156, an exterior side surface, and an exterior rear surface. Most generally, and with a few exceptions, each of the pairs of interior side surfaces 146, interior rear surfaces 148, exterior side surfaces, exterior rear surfaces, interior side surfaces 154, interior rear surfaces 156, exterior side surfaces, and exterior rear surfaces are substantially mirror images of each other. More specifically, the above listed pairs of surfaces are substantially mirror images of each other about a bisection plane 162 (see FIG. 2) that is generally parallel to both the AHU left side 114 and the AHU right side 116 and which is substantially equidistant from both the AHU left side 114 and the AHU right side 116.

Figure 4:
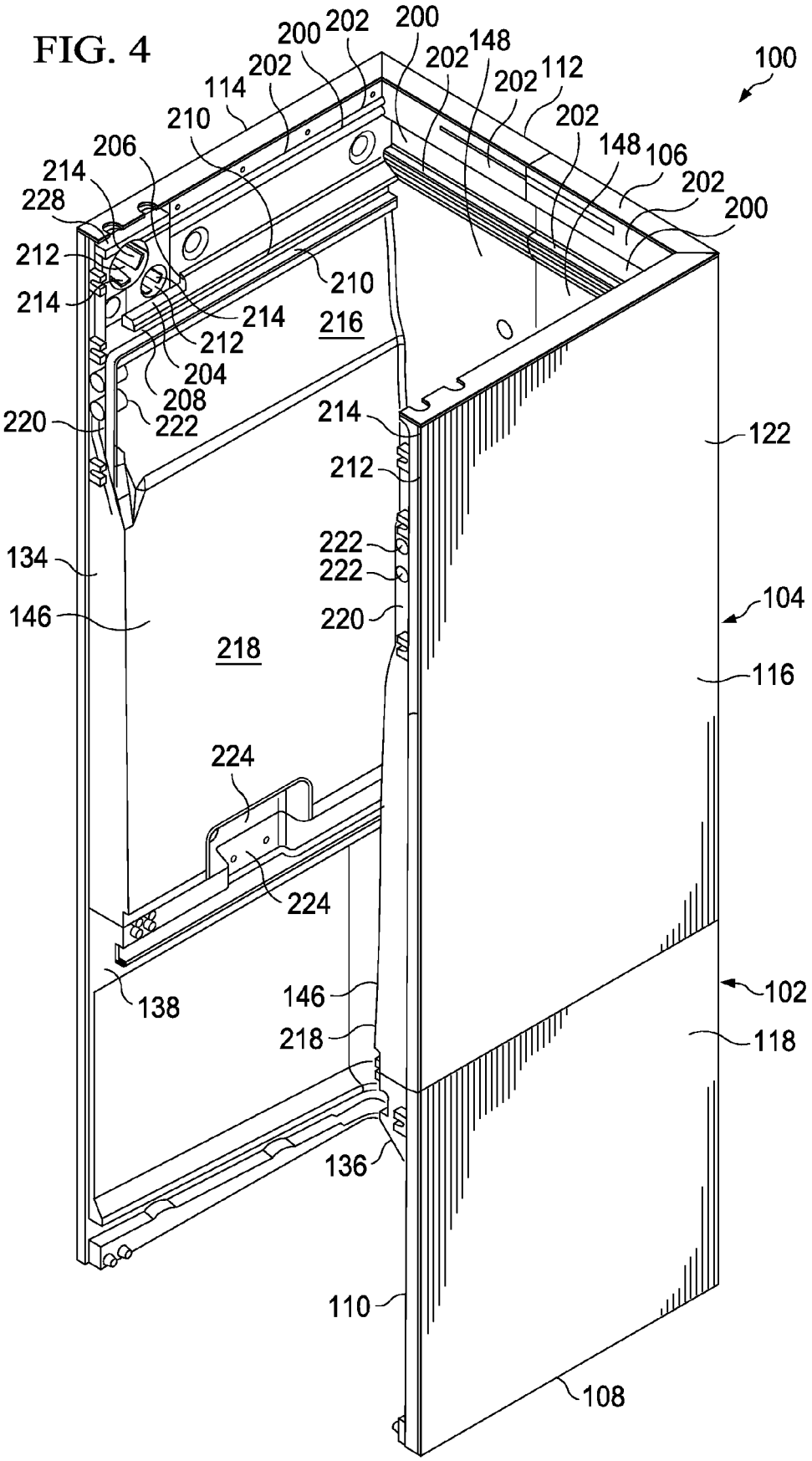
FIG. 4 is a simplified oblique view of the air handling unit of FIG. 1 showing a plurality of inner shell components encased within outer skins.
Figure 5:
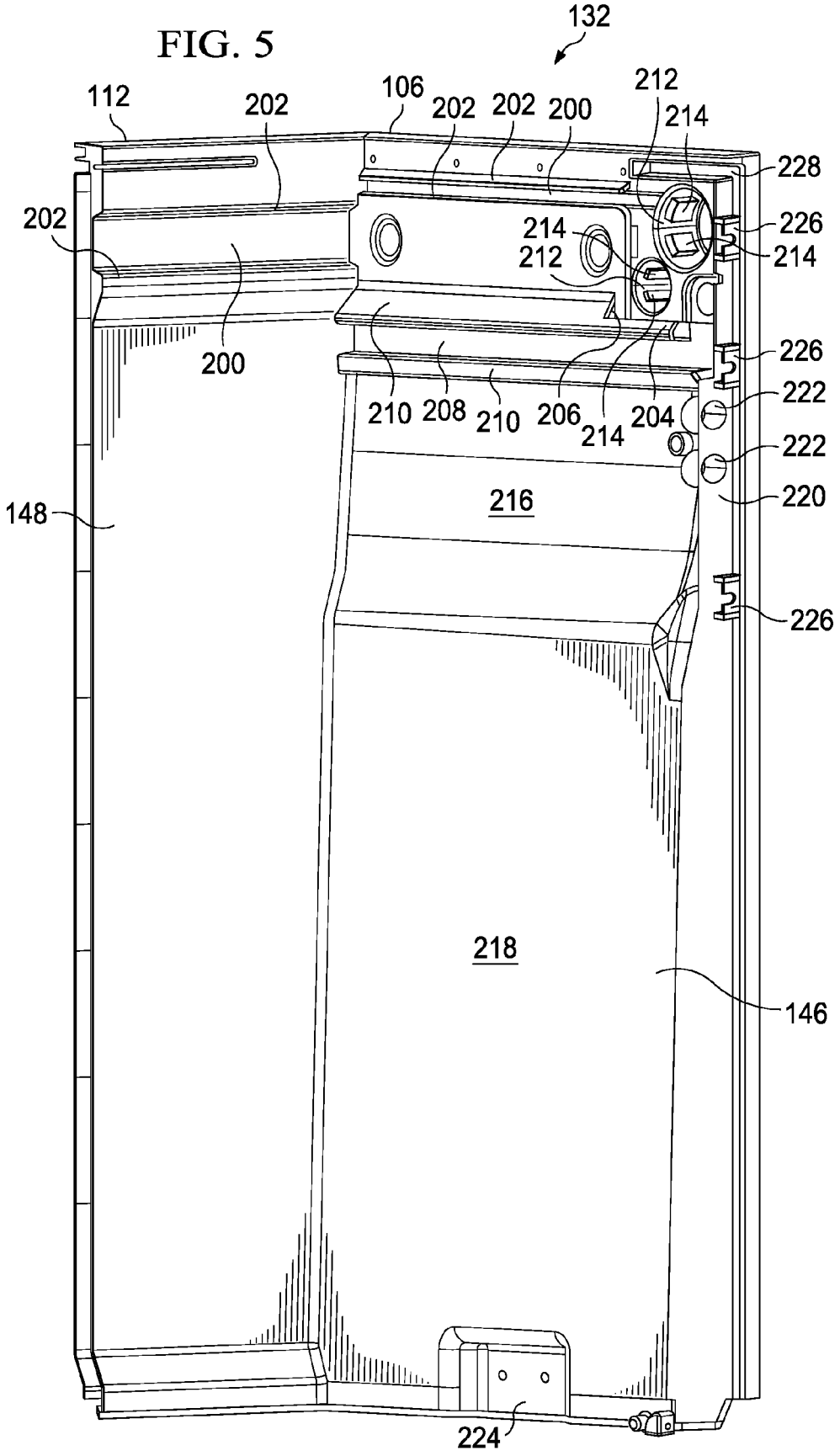
FIG. 5 is an oblique left side view of the heat exchanger cabinet right shell of FIG. 1.

Referring now to FIGS. 4 and 5, simplified views of the AHU 100 are provided. Each of the heat exchanger cabinet right shell 132, the heat exchanger cabinet left shell 134, the blower cabinet right shell 136, and the blower cabinet left shell 138 comprise integral features for carrying removable components of the AHU 100. More specifically, the interior side surfaces 146 and interior rear surfaces 148 of the heat exchanger cabinet right shell 132 and the heat exchanger cabinet left shell 134 comprise heater assembly mounting channels 200 bound above and below by heater assembly rails 202. The heater assembly rails 202 protrude inwardly from the remainder of the respective interior side surfaces 146 and interior rear surfaces 148 so that complementary shaped structures of the heater assembly 126 may be received within the channels 200 and retained within the channels 200 by the heater assembly rails 202. In this embodiment, the heater assembly 126 may be selectively inserted into the heat exchanger cabinet 104 by aligning the heater assembly 126 properly with the heater assembly mounting channels 200 and sliding the heater assembly 126 toward the AHU back side 112. Of course, the heater assembly 126 may be selectively removed from the heat exchanger cabinet 104 by sliding the heater assembly 126 away from the AHU back side 112. Further, one or more of the interior side surfaces 146 may comprise a heater assembly shelf 204 to slidingly receive a portion of the heater assembly 126 during insertion of the heater assembly 126 until the heater assembly 126 abuts a shelf back wall 206.

Still referring to FIGS. 4 and 5, the interior side surfaces 146 of the heat exchanger cabinet right shell 132 and the heat exchanger cabinet left shell 134 comprise refrigeration coil assembly mounting channels 208 bound above and below by refrigeration coil assembly rails 210. The refrigeration coil assembly rails 210 protrude inwardly from the remainder of the respective interior side surfaces 146 so that complementary shaped structures of the refrigeration coil assembly 128 may be received within the channels 208 and retained within the channels 208 by the refrigeration coil assembly rails 210. In this embodiment, the refrigeration coil assembly 128 may be selectively inserted into the heat exchanger cabinet 104 by aligning the refrigeration coil assembly 128 properly with the refrigeration coil assembly mounting channels 208 and sliding the refrigeration coil assembly 128 toward the AHU back side 112. Of course, the refrigeration coil assembly 128 may be selectively removed from the heat exchanger cabinet 104 by sliding the refrigeration coil assembly 128 away from the AHU back side 112.

It will further be appreciated that one or more of the heat exchanger cabinet right shell 132 and the heat exchanger cabinet left shell 134 may comprise integrally formed electrical conduit apertures 212 which form openings between the interior of the heat exchanger cabinet 104 and the heat exchanger cabinet wall space. The electrical conduit apertures 212 are formed and/or shaped to closely conform to the shape of electrical lines and/or electrical conduit that may be passed through the electrical conduit apertures 212. However, in some embodiments, stabilizer pads 214 may be integrally formed about the circumference of the electrical conduit apertures 212 so that the electrical lines and/or electrical conduit may be more tightly held, isolated from the general cylindrical surface of the electrical conduit apertures 212, and/or to reduce friction of insertion of electrical lines and/or electrical conduit while retaining a tight fit between the stabilizer pads 214 and the electrical lines and/or electrical conduit. Further, the stabilizer pads 214 may be configured to interact with nuts of electrical conduit connectors so that the stabilizer pads 214 serve to restrict rotational movement of such nuts. By restricting such rotational movement of nuts, the stabilizer pads 214 may provide easier assembly and/or disassembly of the electrical conduit and related connectors to the heat exchanger cabinet 104. The electrical conduit apertures 212 are not simply holes formed in the interior side surfaces 146, but rather, are substantially tubular protrusions extending outward from the exterior side surfaces.

It will further be appreciated that one or more of the heat exchanger cabinet right shell 132 and the heat exchanger cabinet left shell 134 may comprise drain pan indentions 216. More specifically, the heat exchanger interior side surfaces 146 may generally comprise a sloped portion 218 sloped from a bottom side to the drain pan indentions 216 so that the bottom of the interior side surfaces 146 protrude further inward than the remainder of the sloped portion 218. The drain pan indentions 216 may form a concavity open toward the interior of the heat exchanger cabinet 104. The interior side surfaces 146 further comprise a front boundary wall 220 with integral drain tubes 222 extending into the concavity formed by the drain pan indentions 216. In some embodiments, the AHU 100 may be installed and/or operated in an installation orientation where the drain pan indention 216 of an interior side surface 146 is located below the refrigeration coil assembly 128 and so that fluids may, with the assistance of gravity, aggregate within the concavity of the drain pan indention 216 and thereafter exit the AHU 100 through the integral drain tubes 222. More specifically, the sloped portion 218 may direct fluids falling from the refrigeration coil assembly 128 toward the concavity formed by a drain pan indention 216. In this manner, the integrally formed sloped portion 218, the drain pan indentions 216, and the front boundary wall 220 may serve as a condensation drain pan for the AHU 100 and may prevent the need to install a separate drain pan and/or to rearrange the configuration of a separate drain pan based on a chosen installation orientation for the AHU 100. Further, when in use, a drain pan indention 216 and sloped portion 218 may cooperate with airflow generated by blower assembly 130 to direct condensation to the integral drain tubes 222.

It will further be appreciated that one or more of the heat exchanger cabinet right shell 132 and the heat exchanger cabinet left shell 134 may comprise integral assembly recesses 224. Assembly recesses 224 may be located near a lower end of the heat exchanger cabinet right shell 132 and the heat exchanger cabinet left shell 134. Assembly recesses 224 may accept mounting hardware therein for joining the heat exchanger cabinet 104 to the blower cabinet 102. In this embodiment, the recesses 224 are substantially shaped as box shaped recesses, however, in alternative embodiments, the recesses 224 may be shaped any other suitable manner. Additionally, one or more of the heat exchanger cabinet right shell 132 and the heat exchanger cabinet left shell 134 may comprise integral fastener retainer protrusions 226. Fastener retainer protrusions 226 may be used to hold threaded nuts or other fasteners. Further, in other embodiments, retainer protrusions 226 may themselves be threaded or otherwise configured to selectively retaining fasteners inserted therein. Still further, the heat exchanger cabinet right shell 132 and the heat exchanger cabinet left shell 134 may comprise support bar slots 228 configured to receive the opposing ends of a selectively removable structural crossbar.

Figure 6:
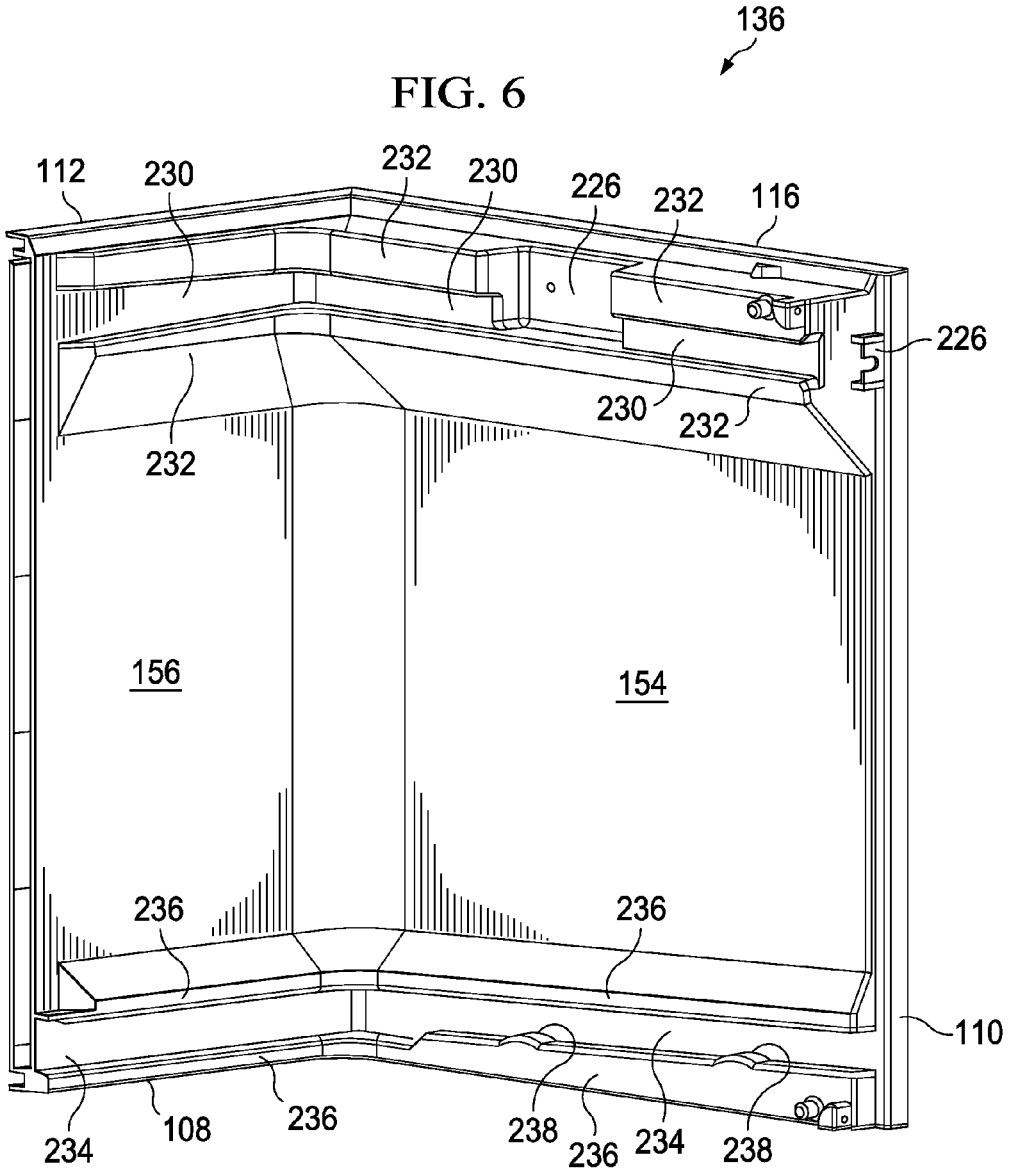
FIG. 6 is an oblique left side view of the blower cabinet right shell of FIG. 1.

Referring now to FIGS. 4 and 6, one or more of the blower cabinet right shell 136 and the blower cabinet left shell 138 may comprise blower assembly mounting channels 230 bound above and below by blower assembly rails 232. The blower assembly rails 232 protrude inwardly from the remainder of the respective interior side surfaces 154 so that complementary shaped structures of the blower assembly 130 may be received within the channels 230 and retained within the channels 230 by the blower assembly rails 232. In this embodiment, the blower assembly 130 may be selectively inserted into the blower cabinet 102 by aligning the blower assembly 130 properly with the blower assembly mounting channels 230 and sliding the blower assembly 130 toward the AHU back side 112. Of course, the blower assembly 130 may be selectively removed from the blower cabinet 102 by sliding the blower assembly 130 away from the AHU back side 112.

It will further be appreciated that one or more of the blower cabinet right shell 136 and the blower cabinet left shell 138 may comprise filter mounting channels 234 bound above and below by filter rails 236. The filter rails 236 protrude inwardly from the remainder of the respective interior side surfaces 154 so that complementary shaped structures of a filter may be received within the channels 234 and retained within the channels 234 by the filter rails 236. In this embodiment, a filter may be selectively inserted into the blower cabinet 102 by aligning the filter properly with the filter mounting channels 234 and sliding the filter toward the AHU back side 112. Of course, the filter may be selectively removed from the blower cabinet 102 by sliding the filter away from the AHU back side 112. In some embodiments, the filter mounting channel 234 may be sloped downward from the front to the back of the AHU 100. Further, in some embodiments, one or more of the filter rails 236 may comprise filter protrusions 238 which may serve to more tightly hold a filter inserted into the filter mounting channels 234. In some embodiments, one or more of the blower cabinet right shell 136 and the blower cabinet left shell 138 may comprise fastener retainer protrusions 226. Still further, one or more of the blower cabinet right shell 136 and the blower cabinet left shell 138 may comprise integral assembly recesses 240. Assembly recesses 240 may be located near an upper end of the blower cabinet right shell 136 and the blower cabinet left shell 138. Assembly recesses 240 may accept mounting hardware therein for joining the blower cabinet 102 to the heat exchanger cabinet 104. In this embodiment, the recesses 240 are substantially shaped as box shaped recesses, however, in alternative embodiments, the recesses 240 may be shaped in any other suitable manner.

While many of the features of the heat exchanger cabinet right shell 132, heat exchanger cabinet left shell 134, blower cabinet right shell 136, and blower cabinet left shell 138 may be formed integrally to those respective components in a single molding and/or injection process. However in alternative embodiments, the various integral features may be provided through a series of moldings, and/or injections, thermal welding, gluing, or any other suitable means of assembling a singular structure comprising the various features as is well known to those skilled in the art. Further, one or more of the components disclosed herein as being formed integrally, in some embodiments, may be formed from multiple components coupled together.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: $R=RI+k*(Ru-RI)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An air handling unit, comprising:

a first interior wall comprising:

a first integral rail and a second integral rail, wherein each of the first integral rail and the second integral rail protrude from the first interior wall towards an interior space of the air handling unit, wherein the first interior wall is fixed relative to the air handling unit, and wherein the first integral rail and the second integral rail are fixed relative to the first interior wall; and a first mounting channel that is open toward the interior space and that is configured to selectively slidably receive a removable component of the air handling unit; and a second interior wall disposed opposite of the first interior wall and comprising:

a third integral rail and a fourth integral rail, wherein each of the third integral rail and the fourth integral rail protrude from the second interior wall towards the interior space of the air handling unit, wherein the second interior wall is fixed relative to the air handling unit, and wherein the third integral rail and the fourth integral rail are fixed relative to the second interior wall; and a second mounting channel that is open toward the interior space and that is configured to selectively slidably receive the removable component of the air handling unit;

wherein the first integral rail, the second integral rail, and the first mounting channel of the first interior wall form at least a portion of the fluid duct through the air handling unit, wherein the first mounting channel is bound by the first integral rail on an upstream side and bound by the second integral rail on a downstream side with respect to a primary airflow direction through the air handling unit such that the first integral rail and the second integral rail retain the removable component within the first mounting channel by receiving a complementary shaped structure of the removable component within the first mounting channel and retaining the complementary shaped structure of the removable component within the first mounting channel with the first integral rail and the second integral rail; and wherein the third integral rail, the fourth integral rail, and the second mounting channel form at least a portion of the fluid duct through the air handling unit, wherein the second mounting channel is bound by the third integral rail on an upstream side and bound by the fourth integral rail on a downstream side with respect to a primary airflow direction through the air handling unit such that the third integral rail and the fourth integral rail retain the removable component within the second mounting channel by receiving a second complementary shaped structure of the removable component within the second mounting channel and retaining the second complementary shaped structure of the removable component within the second mounting channel with the third integral rail and the fourth integral rail.

2. The air handling unit of claim 1, wherein the first mounting channel and the second mounting channel are configured to slidably receive the removable component.

3. The air handling unit of claim 2, wherein (1) at least one of the first integral rail and the second integral rail and (2) at least one of the third integral rail and the fourth integral rail restricts movement of the removable component.

4. The air handling unit of claim 1, wherein the removable component is a blower assembly.

5. The air handling unit of claim 1, wherein the removable component is a refrigeration coil assembly.

6. The air handling unit of claim 1, wherein the removable component is a heater assembly.

7. An air handling unit, comprising:

an interior wall;

an outer skin joined to the interior wall; and an insulator disposed between the interior wall and the outer skin;

wherein the interior wall comprises (1) a first integral rail and a second integral rail that each protrude from the interior wall towards an interior space of the air handling unit and (2) a mounting channel that is open toward the interior space and that is configured to selectively slidably receive a removable component of the air handling unit;

wherein the interior wall is fixed relative to the outer skin, wherein the first integral rail and the second integral rail are fixed relative to the interior wall, wherein the first integral rail, the second integral rail, and the mounting channel form at least a portion of the fluid duct through the air handling unit, wherein the first integral rail is located immediately adjacently upstream of the mounting channel and the second integral rail is located immediately adjacently downstream of the mounting channel with respect to a primary airflow direction through the fluid duct such that the integral rail retains the removable component within the mounting channel by receiving a complementary shaped structure of the removable component within the mounting channel and retaining the complementary shaped structure of the removable component within the mounting channel with the first integral rail and the second integral rail, and wherein the insulator is further disposed between the outer skin and at least one of the first integral rail, the second integral rail, and the mounting channel.

8. The air handling unit according to claim 7, wherein the interior wall is further configured as a drain pan.

9. The air handling unit according to claim 7, wherein the interior wall further comprises electrical conduit apertures extending toward the outer skin.

10. The air handling unit according to claim 7, wherein the removable component is an air filter.

11. The air handling unit according to claim 7, wherein the air handling unit comprises a plurality of interior walls configured to selectively retain a refrigeration coil assembly, a heater assembly, and a blower assembly.

* * * * *